United States Patent [19]

Scheurecker et al.

[11] 4,079,777

[45] Mar. 21, 1978

[54] APPARATUS FOR EXTRACTING A STARTER BAR AND FOR SUPPORTING AND EXTRACTING A CAST STRAND

[75] Inventors: Werner Scheurecker; Alois Scheinecker, both of Linz, Austria

[73] Assignee: Vereinigte Osterreichische Eisen- und Stahlwerke - Alpine Montan Aktiengesellschaft, Linz, Austria

[21] Appl. No.: 760,449

[22] Filed: Jan. 19, 1977

[30] Foreign Application Priority Data

Jan. 27, 1976 Austria ..... 530/76

[51] Int. Cl.[2] ..... B22D 11/08; B22D 11/128

[52] U.S. Cl. ..... 164/448; 164/82

[58] Field of Search ..... 164/282, 82; 425/363

[56] References Cited

U.S. PATENT DOCUMENTS

| | | | |
|---|---|---|---|
| B 396,916 | 3/1976 | Bode, Jr. et al. | 164/282 |
| 3,757,848 | 9/1973 | Scholz et al. | 164/282 |
| 3,867,827 | 2/1975 | Backhous et al. | 164/282 X |
| 3,891,025 | 6/1975 | Bollig et al. | 164/282 |
| 3,946,798 | 3/1976 | Uchimoto et al. | 164/282 |
| 3,993,424 | 11/1976 | Pawelczyk et al. | 425/363 |
| 4,018,261 | 4/1977 | Scheinecker et al. | 164/282 |

*Primary Examiner*—Robert L. Spicer, Jr.
*Attorney, Agent, or Firm*—Brumbaugh, Graves, Donohue & Raymond

[57] ABSTRACT

An apparatus for extracting a starter bar and for supporting and extracting a cast strand to be used in a continuous casting plant has at least two upper driving rollers arranged to form a first unit and at least two lower driving rollers arranged to form a second unit and a stand. Transverse carriers guided in the stand and are movable relative to each other, have the upper driving rollers mounted on them. Head beams articulately connect the transverse carriers at the ends thereof and adjustment drives are articulately connected to the ends of the head beams for adjustment of said first unit and said second unit relative to each other.

10 Claims, 6 Drawing Figures

APPARATUS FOR EXTRACTING A STARTER BAR AND FOR SUPPORTING AND EXTRACTING A CAST STRAND

BACKGROUND OF THE INVENTION

The invention relates to an apparatus for extracting a starter bar and for supporting and extracting a cast strand in a continuous casting plant having at least two upper and two lower driving rollers mounted in a stand, which rollers are each arranged to form separate units that are adjustable relative to each other by means of adjustment drives.

Apparatusses have been known in which the upper driving rollers are mounted in pivotable rockers (Austrian Pat. No. 301,781). They have, however, the disadvantage that the upper rollers are not adjustable themselves, but only in dependence upon the rocker arms, so that when the casting thickness changes, in particular at the transitions from the cold strand to both the cold strand head and the cast strand, uncontrolled forces are applied. By applying the tensile force onto the strand, tilting moments are created which cause one roller of the rocker to be pressed onto the strand and the other one to be lifted off with the consequence that partly excessive, and thus unbalanced, forces act on the strand and cause its quality to deteriorate.

SUMMARY OF THE INVENTION

The invention aims at avoiding these disadvantages and difficulties and has as its object to provide an extraction apparatus of the above-defined kind, which assures a controlled adjustment of the upper rolls and a reliable application of the extraction forces at points where the thickness of the cast strand changes and at the transition from the cold strand to the cast strand.

The invention comprises the mounting of the upper driving rollers in transverse carriers, which transverse carriers are guided in the stand, are movable relative to each other and are articulately connected at their ends by head beams that in turn are articulately connected at their ends with adjustment drives.

Suitably, the transverse carriers are connected with the head beams by articulation bearings, whereby the position of the transverse carriers is adapted to the respective strand surface and the transverse carriers can be moved independently of each other.

Advantageously, each transverse carrier is connected with a head beam by a hinge pin bearing.

Suitably, the transverse carriers can be supported relative to the upper part of the stand by spacers corresponding to the desired casting thickness.

Advantageously, hydraulic cylinders are inserted between the transverse carrier and the upper part of the stand as an overload protection means.

It is furthermore suitable, for the head beams to be connected with the adjustment drives by hinges having articulation bearings.

For an easier removability of the adjustment drives and the transverse carriers the hinges have a removable lid, the removal of which permits the adjustment drives and the transverse carriers to be taken out.

According to a preferred embodiment, the transverse carriers are articulately connected by a guide rod connection arranged parallel to the head beam connection.

A further advantageous embodiment is characterized in that the transverse carriers have guide shoes embracing guide plates arranged on the stand.

For use in continuous slab casting plants, advantageously the driving rollers are supported a number of times along their longitudinal extension on the transverse carriers.

BRIEF DESCRIPTION OF THE DRAWINGS

The invention shall now be explained in more detail by way of example only, and with reference to the accompanying drawings, wherein.

DESCRIPTION OF EXEMPLARY EMBODIMENTS

Figure 6:
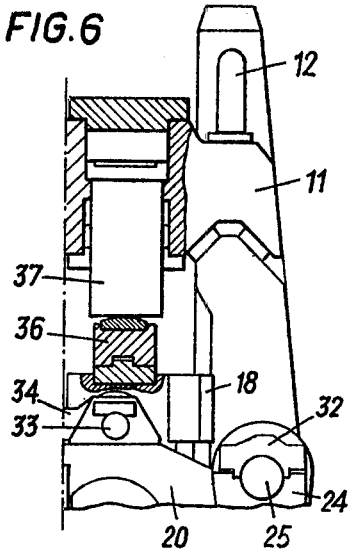
FIG. 6 shows a further embodiment of the invention in an illustration analogous to that of FIG. 1.

By 1 and 2 oppositely arranged driving rollers are denoted, which rollers are supported a number of times along their longitudinal extension against transverse carriers. They are drivable by slip on gear motors 3 mounted at their ends. Adjacent the driving rollers, there are supporting and guiding rollers 4 mounted in separate stands, which rollers 4 support the strand at two opposite sides thereof. They form the arc-outer and the arc-inner roller path of an arcuate continuous casting plant and are entered in FIG. 1 in broken lines. The two lower driving rollers 1, i.e. those allocated to the arc-outer roller path, are mutually fastened to a one-piece transverse carrier 5 via bearings 6 and bearing supports 7. The transverse carrier 5 is, by means of screws 8, rigidly connected to form a unit with two U-shaped standards 9 arranged at the driving roller ends and open towards the top. The standards 9 are secured to carriers 10 mounted on the base with intermediate exchangeable supports 10'. Each standard 9 is closed at its upper end by means of a longitudinal head beam 11 to form a frame, the longitudinal head beam being mounted on each standard with wedge connections 12. For connecting the two standards at their upper ends there is arranged a cross strut 13 directed to be parallel to the driving roller axes and central to the longitudinal head beams 11. In this manner a rigid, spacial stand is formed.

Figure 4:
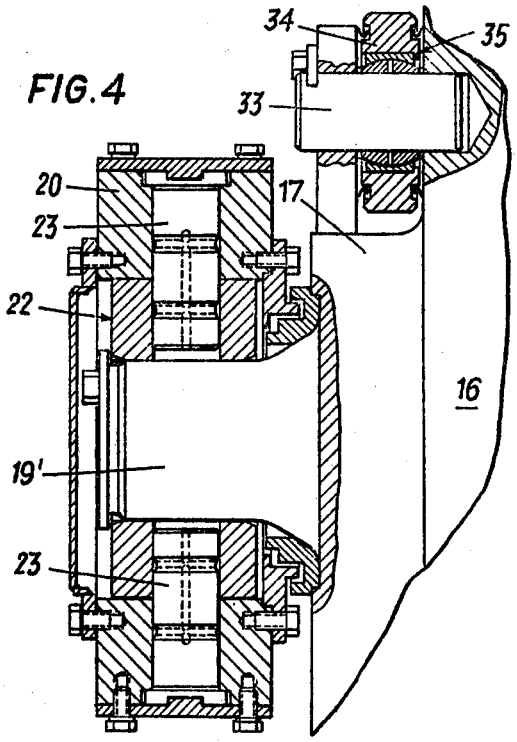

Each one of the two driving rollers 2 arranged at the upper side of the strand or inner side of the arc is supported at its bearings 14 on a separate transverse carrier 16 via bearing supports 15. The two transverse carriers extend with their ends 17 to beyond the frame formed by the standards 9 and are guided along slide paths 18. At the ends 17 of the transverse carriers 16 pins 19 and 19' are arranged, which pins are mounted in a head beam 20 articulately connecting the transverse carriers. One pin 19 of each transverse carrier is journaled in the head beam 20 by means of an articulation bearing 21 and the other pin 19', arranged at the other end of each carrier is also journalled by means of a hinge pin bearing 22 in the head beam 20. At each head beam one articulation bearing and one hinge pin bearing are always arranged, The articulation bearings 21 illustrated in more detail in FIG. 3 not only permit a rotatable movement of the pin 19 around its axis, but also a pivotal movement of the pin in any desired direction; their function can be compared to spherical bearings. The hinge pin bearings 22 permit, beside the rotary movement of the pin 19' around its axis, only a pivot movement about the axis of pin 23 (FIG. 4). These bearings prevent a lateral tilting off of the head beams 20.

Figure 1:
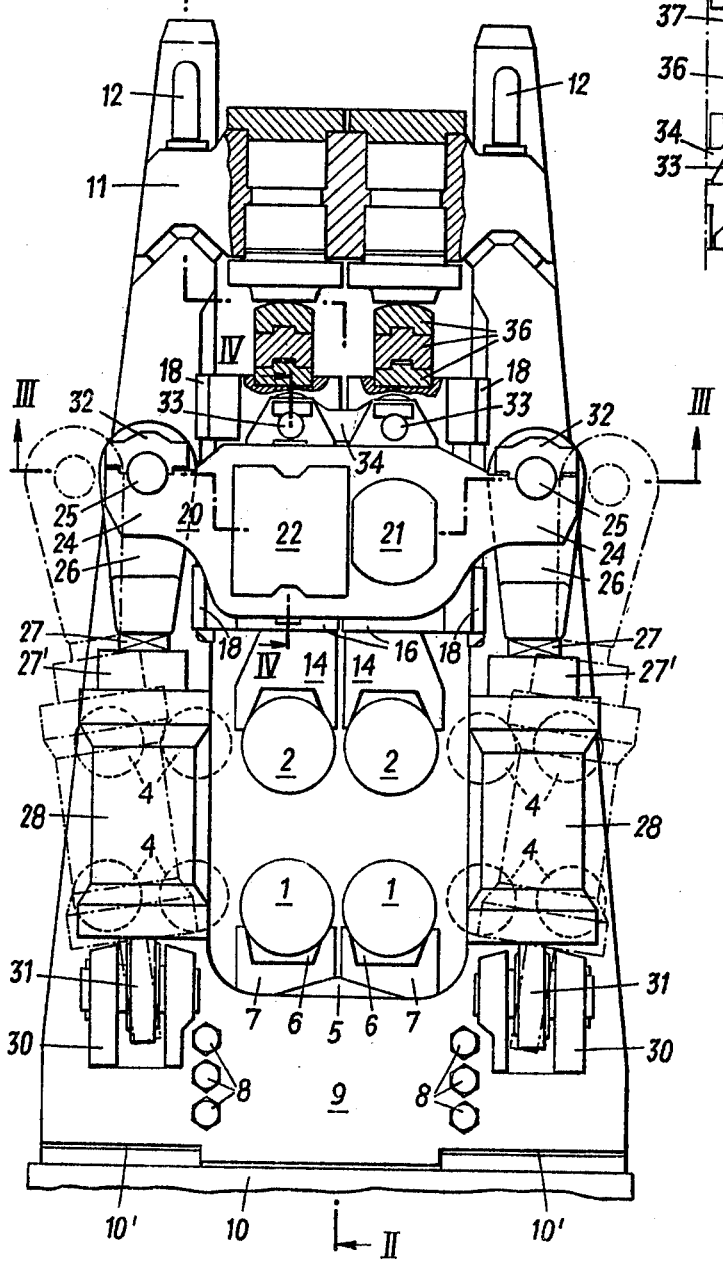
FIG. 1 is a side view of an embodiment of the apparatus according to the invention, partly in section.
Figure 2:
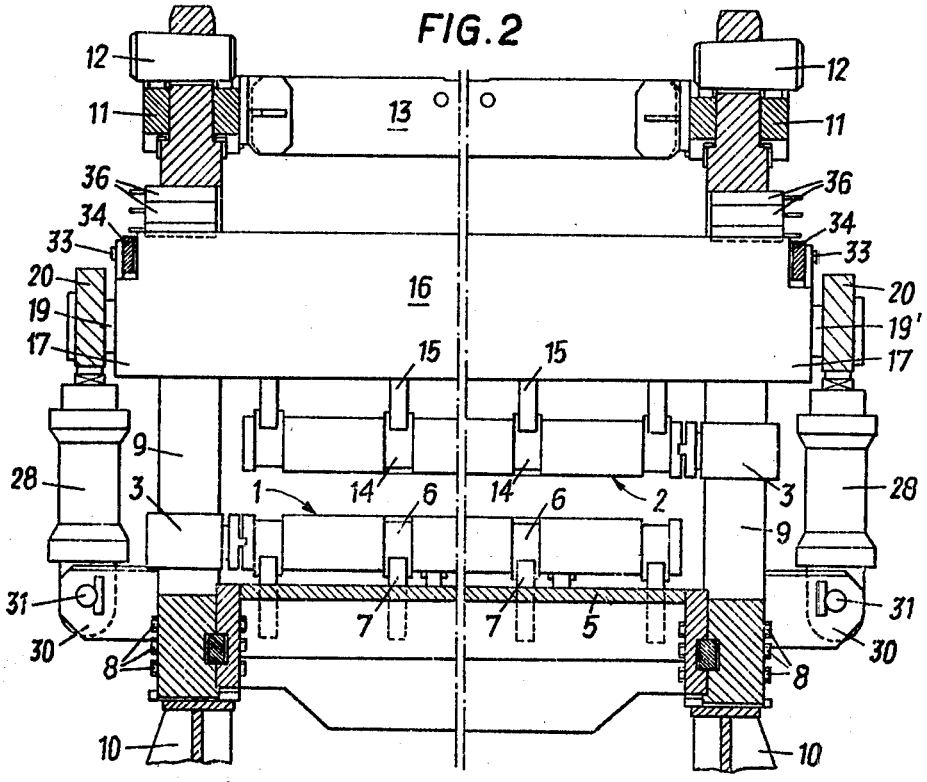
FIG. 2 is a section along line II—II of FIG. 1, FIGS. 3 and 4 show partial sections along lines III—III and IV—IV, respectively, of FIG. 1, on an enlarged scale.
Figure 3:
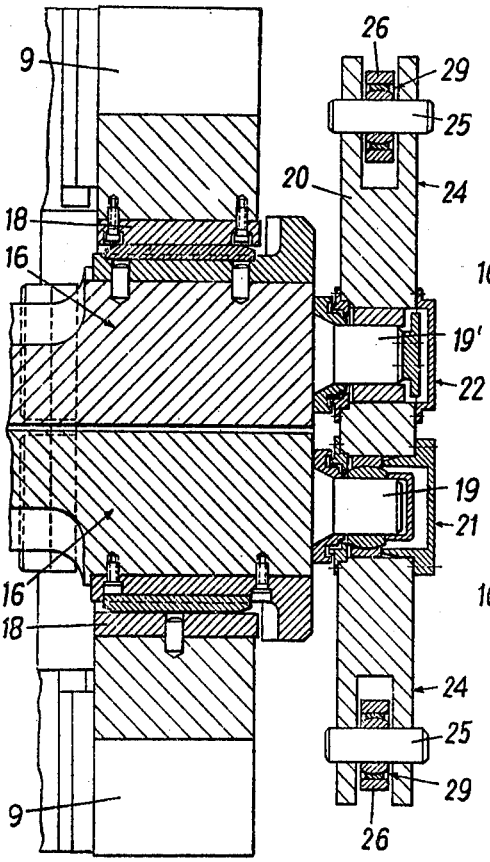

The ends of each head beam 20 are designed as fork heads 24, whose bolts 25 are mounted in eyes 26 of piston rods 27 of pressure medium cylinders 28 by means of articulation bearings 29 (FIGS. 1 and 3). Each pressure medium cylinder 28 is also hinged by means of an articulation bearing 31 to a console 30 mounted on the standard. The pressure medium cylinders are so arranged that the perpendicular columns of the U-shaped standards 9 are between them and the strand guiding path, whereby they are protected from excessive thermal strain. The fork heads 24 of the head beams 20 are provided with removable lids 32 after removal of the lids 32 the pressure medium cylinders 28 can be pivoted into the position entered in FIG. 1 in dot-and-dash lines. Thus an easy mounting and removal of the transverse carriers 16 as well as the pressure medium cylinders 28 becomes possible. The transverse carriers 16 and the pressure medium cylinders 28 can be installed and removed independently of each other. At the ends 17 of the transverse carriers 16, above the pins 19 and 19' mounted in the head beams 20, further pins 33 are arranged. Pins 33 are mounted with articulation bearings 35 in guide rods 34 arranged parallel to the head beams 20 and connecting the transverse carriers adjacent the head beams 20. The two transverse carriers 16 thus form a linkage parallelogram at each of their ends with a head beam 20 (FIG. 4) and a guide rod 34.

The application of the pressure force necessary for transmitting the torque of the driving rollers to the strand is effected by the pressure medium cylinders 28. For determining a maximum distance of the oppositely arranged driving rollers 1 and 2 there are provided exchangeable spacers 36 which can be inserted between the longitudinal head beams 11 and the transverse carriers 16 and thus delimit the displacement path of the transverse carriers 16 in the direction to the longitudinal head beams 11. In the opposite direction the displacement path is delimited by stops 27' provided at the piston rods 27 of the pressure medium cylinders 28. As overload protection means, hydraulically actuated pressure medium cylinders 37 can be installed between the transverse carriers 16 and the longitudinal head beams 11, as illustrated in FIG. 6. The pressure medium cylinders 37 yield when a certain load caused by the strand acts on the driving rollers, so that the transverse carriers and with them the driving rollers 2 can make way in the direction perpendicularly away from the strand surface.

Figure 5:
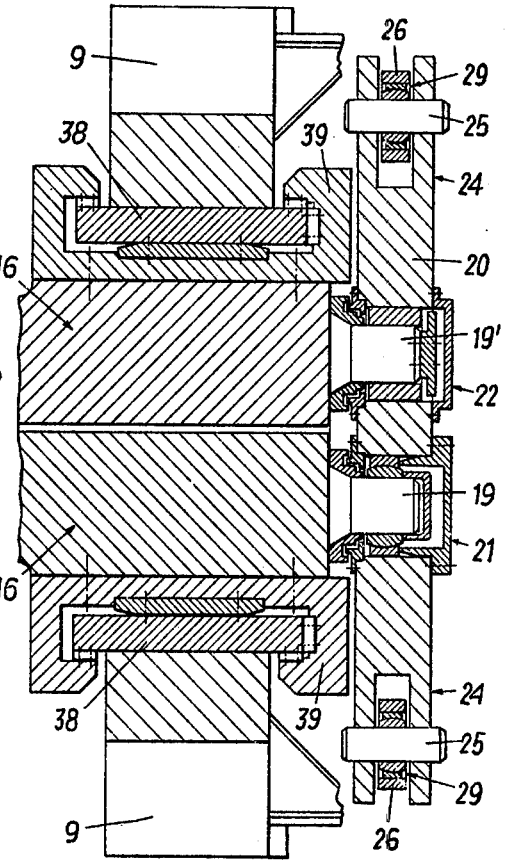
FIG. 5 shows another embodiment of the invention in an illustration analogous to that of FIG. 3.

Instead of the guide rods 34, guides 38 can be arranged at the standards so as to project laterally, as illustrated in FIG. 5, and to engage with guide shoes 39 mounted on the transverse carriers 16.

We claim:

1. In an apparatus for extracting a starter bar and for supporting and extracting a cast strand in a continuous casting plant, of the type including at least two upper driving rollers forming a first unit, at least two lower driving rollers forming a second unit, a stand for mounting said upper driving rollers and said lower driving rollers therein, and adjustment drives for adjustment of the distance of said first unit and said second unit relative to each other, the improvement comprising:

transverse carriers for separately mounting each of the at least two upper driving rollers on its own separate transverse carrier, the transverse carriers being guided in the stand and movable relative to one another, and head beams articulately connecting the ends of the at least two transverse carriers by means of at least two connection bearings capable of rotary motion, the head beams in turn being articulately connected at their ends to said adjustment drives, at each head beam one of the at least two connection bearings being capable of pivotal motion in only one plane perpendicular to the longitudinal axis of the transverse carrier about which the rotary motion takes place and the other connection bearing being capable of universal pivotal motion perpendicular to the longitudinal axis of the transverse carrier about which the rotary motion takes place.

2. An apparatus as set forth in claim 1, wherein the bearings capable of universal pivotal motion and articulately connecting the head beams with the transverse carriers are articulation bearings.

3. An apparatus as set forth in claim 1, wherein the bearings capable of pivotal motion in only one plane and connecting the transverse carriers with the head beams are hinge pin bearings.

4. An apparatus as set forth in claim 1, further comprising hydraulic cylinders provided between the transverse carriers and the upper part of the stand as overload protection means.

5. An apparatus as set forth in claim 1, wherein the head beams are articulately connected with the adjustment drives by hinges having articulation bearings.

6. An apparatus as set forth in claim 1, further comprising a guide rod connection extending parallel to the head beams and articulately connecting the transverse carriers.

7. An apparatus as set forth in claim 1, further comprising guides arranged on the stand and guide shoes arranged on the transverse carriers and embracing said guides.

8. An apparatus as set forth in claim 1, wherein the driving rollers are multiply supported on the transverse carriers along their longitudinal extension.

9. In an apparatus, for extracting a starter bar and for supporting and extracting a cast strand in a continuous casting plant, of the type including at least two upper driving rollers forming a first unit, at least two lower driving rollers forming a second unit, a stand for mounting said upper driving rollers and said lower driving rollers therein, and adjustment drives for adjustment of the distance of said first unit and said second unit relative to each other, the improvement comprising:

transverse carriers guided in the stand and movable relative to one another, said upper driving rollers being mounted on said transverse carriers, head beams articulately connecting the transverse carriers at the ends thereof, the head beams being in turn articulately connected at the ends thereof to said adjustment drives, and spacer pieces having a thickness corresponding to a desired casting thickness for supporting the transverse carriers relative to the upper part of the stand.

10. In an apparatus, for extracting a starter bar and for supporting and extracting a cast strand in a continuous casting plant, of the type including at least two upper driving rollers forming a first unit, at least two lower driving rollers forming a second unit, a stand for mounting said upper driving rollers and said lower driving rollers therein, and adjustment drives for adjustment of the distance of said first unit and said second unit relative to each other, the improvement comprising:

transverse carriers guided in the stand and movable relative to one another, said upper driving rollers being mounted on said transverse carriers, head beams articulately connecting the transverse carriers at the ends thereof, and hinges with articulation bearings for articulately connecting the ends of the head beams to said adjustment drives, said hinges having removable lids which permit the adjustment drives and the transverse carriers to be removed from the stand.

* * * * *